US005755440A

United States Patent [19]

Sher

[11] Patent Number: 5,755,440

[45] Date of Patent: May 26, 1998

[54] ENHANCED ROULETTE-STYLE GAME

[76] Inventor: Abraham M. Sher, 337 S. Wethekly Dr., Beverly Hills, Calif. 90211

[21] Appl. No.: 780,581

[22] Filed: Jan. 8, 1997

[51] Int. Cl.[6] ..... A63F 5/00

[52] U.S. Cl. ..... 273/142 E; 273/142 HA; 463/17; 463/32; 463/34; 463/35

[58] Field of Search ..... 273/142 E, 138.2, 273/142 H, 142 HA, 274, 142 R, 143 R; 463/17, 31, 32, 33, 34, 35

[56] References Cited

U.S. PATENT DOCUMENTS

| | | | |
|---|---|---|---|
| 1,376,199 | 4/1921 | Gotsche | 273/142 HA |
| 4,391,442 | 7/1983 | Levy | 273/142 E |
| 4,989,873 | 2/1991 | Manabe | 273/142 E |
| 5,580,055 | 12/1996 | Hagiwara | 273/143 R |
| 5,618,232 | 4/1997 | Martin | 463/25 |

FOREIGN PATENT DOCUMENTS

| | | | |
|---|---|---|---|
| 2912193 | 10/1980 | Germany | 273/138 A |
| 3435956 | 4/1986 | Germany | 273/142 E |
| 8201611 | 5/1982 | WIPO | 273/138 A |

*Primary Examiner*—Benjamin H. Layno
*Attorney, Agent, or Firm*—Donald R. Boys

[57] ABSTRACT

A new Roulette apparatus comprises multiple balls and separate tracks for launching each of the balls. In a preferred embodiment there are two balls and two tracks. Also in a preferred embodiment special apparatus is provided for launching the balls. In one embodiment the launching apparatus is air powered, and in another the apparatus is mechanical with the balls accelerated by contact with a spinning wheel. In either case the launching apparatus may be hand-held or mounted to a frame and positioned to propel the balls into the tracks. In another aspect of the invention the wheel of the Roulette apparatus is provided as a dynamic display, which may be of several different types, such as LCD and dynamic holographic displays, and electronic player stations are provided wherein players may customize and place bets. In many embodiments the games are enhanced by audio effects including such sounds as balls being launched, balls rolling in Roulette apparatus, thunder strikes, and music.

15 Claims, 6 Drawing Sheets

ENHANCED ROULETTE-STYLE GAME

FIELD OF THE INVENTION

The present invention is in the area apparatus and methods for gambling games, and pertains more particularly to enhancements for games of chance known as Roulette.

BACKGROUND OF THE INVENTION

Gambling has historically been a favorite pastime for many (and an obsession for some), and at the time of the present patent application enjoyes very rapid growth. More and more local governments, for example, are promoting gambling of various sorts as a tool to generate increased tax revenues. Gambling is also being promoted more and more as a tool for providing income for various Native American groups, sanctioned by the U. S. Federal government. In the private sector as well the public sector, gambling continues to enjoy healthy growth.

Legalized gambling represents the fastest growing sector of the entertainment business. Between 1988 and 1994, annual casino revenues nearly doubled, from $8 billion to $15 billion. It is estimated that members of over 100 million American households gambled at casinos some time during the past 12 months, up from 46 million just 5 years ago. In 1994, Americans spent approximately 8.5% of the total national income on legalized gambling. In 1995, the gambling industry in the United States was expected to generate revenues in excess of $500 billion. Various gambling operations, from casinos to state lotteries, keep approximately 8% of that money, or $40 billion. This amount constitutes more than the net revenues of the United States movie and record industries combined. The gaming industry is approximately the size of the commercial airline industry.

One gambling game that has historically enjoyed relative popularity is the game of roulette, wherein wagers are placed on the likelihood of a metal ball, having been propelled around a track in a rotary direction opposite the rotary direction of a central wheel having indentions (cassettes) where the ball can come to rest, landing in one or another of the available final positions. The game of Roulette is described in detail in two references in the possession of and familiar to the inventor. The references are: "Winning Tips for Casino Games" by John Grochowski, and "Beating the Wheel—Winning Strategies at Roulette" by Russel T. Barnhart. Both of these references are incorporated in this specification by reference.

It is well-known in the art that Roulette has recently been slipping in popularity. It is now the least popular gambling game among slot machines, Video Poker, Blackjack, or Craps, each of which is a major casino game. Roulette draws more players than Bacarrat only. Moreover, there are new games recently introduced that also threaten to be more popular than conventional Roulette. One of these is "Caribbean Stud Poker" and another is "Let It Ride", both of which are known to those with skill in the art.

In Europe, however, Roulette is still very popular. The main reason Roulette is still very popular in Europe is that European Roulette wheels have only one zero, whereas American Roulette wheels have both a zero and a double zero. The American wheels, therefore, reduce the chances of the player winning and substantially improve the house odds.

For Roulette to achieve its past high levels of popularity, what is needed is a new type of Roulette that will reintroduce excitement to the game, which can be accomplished, in part, by increasing the odds of winning. Another necessary enhancement is to improve the speed at which the game can be played. In that manner, perhaps the operators of casinos would be content with lower odds of the house winning, such as the European version of the game that only contains a single "0" bet (and eliminating the U.S. version "00" bet), or by increasing the number of persons playing the game, thereby increasing the cumulative total of casino revenues from the game. The present invention provides answers to these needs in the form of a new and exciting Roulette-style game.

SUMMARY OF THE INVENTION

In a preferred embodiment of the present invention, a Roulette wheel is provided comprised of a first track with a first substantially vertical outer wall in the form of a cylindrical section and a first inwardly inclined land portion extending radially inward from a lower end of the substantially vertical wall; a second track, having a second substantially vertical outer wall in the form of a cylindrical section and a second inwardly inclined land portion extending radially inward from a lower end of the second substantially vertical wall, the vertical outer wall of the second track beginning at the inboard edge of the first track; and a circular region of numbered cassettes below and within the first and second tracks. The second track in a preferred embodiment is joined to the circular region of numbered cassettes by an inwardly-inclined conical region, and further comprises an outwardly-inclined conical region within the circular region of numbered cassettes. In many embodiments, there are projections from a surface of the inclined conical region, the projections placed for interrupting the path of a ball traveling over the surface in the inwardly-inclined conical region.

Special apparatus adapted for propelling a first ball substantially tangentially into the first track and a second ball substantially tangentially into the second track is provided in an aspect of the invention. This apparatus may be a hand-held device having separate ejection tubes for the first and second balls, wherein the balls are propelled by a burst of gas pressure in the ejection tubes. The apparatus may be mounted to a frame supporting the Roulette wheel and positioned to propel the balls into the tracks. The propelling apparatus may also be a device having a vertically-oriented entrance tube, and a horizontally-inclined ejection tube, and a ball dropped into the entrance tube is propelled from the ejection tube by contact with a driven wheel.

The mechanical apparatus for propelling balls in a preferred embodiment has two vertically-oriented entrance tubes, each connected to a separate ejection tube, and the apparatus is mounted to a frame supporting the Roulette wheel and is adapted to have one ejection tube positioned to propel a ball into each of the tracks.

In another aspect, a Roulette apparatus is provided comprising a first track, having a first substantially vertical outer wall in the form of a cylindrical section and a first inwardly inclined land portion extending radially inward from a lower end of the substantially vertical wall; a second track, having a second substantially vertical outer wall in the form of a cylindrical section and a second inwardly inclined land portion extending radially inward from a lower end of the second substantially vertical wall, the vertical outer wall of the second track beginning at the inboard edge of the first track; a circular region of numbered cassettes below and within the first and second tracks; a first ball and a second ball; and an apparatus adapted for propelling a first ball substantially tangentially into the first track and a second ball substantially tangentially into the second track. Many variations of this apparatus are described in more detail below.

The Roulette apparatus in this embodiment further comprises a betting field having numbered areas associated with the numbered cassettes such that players may place bets by placing money, chips or scrip on the numbered areas in the betting field, and in some embodiments at least one player station is provided in a manner that is adapted to enable a player to place additional bets. Such player stations may be permanently marked as to the bet placed at the station, or may alternatively be adapted with electronic interfaces, including input devices for a player to customize the bet.

In yet another aspect of the invention, a virtual Roulette apparatus is provided comprising a dynamic holographic Roulette wheel; at least one player station, having an electronic interface including input devices for a player to customize and place bets; and a computer section adapted for managing operation of the apparatus, including generating the dynamic holographic Roulette wheel and operating at least one player station.

BRIEF DESCRIPTION OF THE DRAWING FIGURES

DESCRIPTION OF THE PREFERRED EMBODIMENTS

Figure 1A:
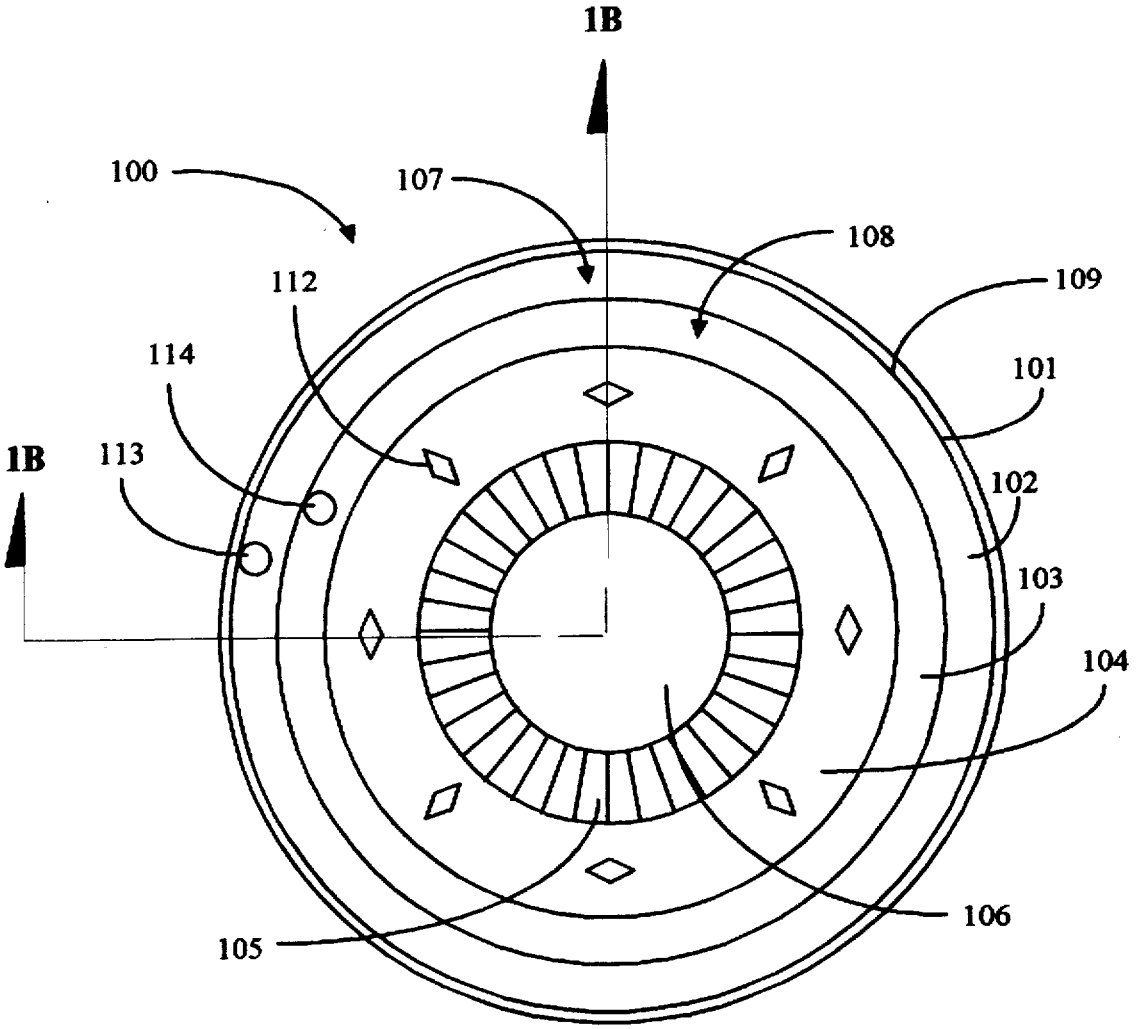
FIG. 1A is a plan view of a Roulette wheel according to an embodiment of the present invention.
Figure 1B:
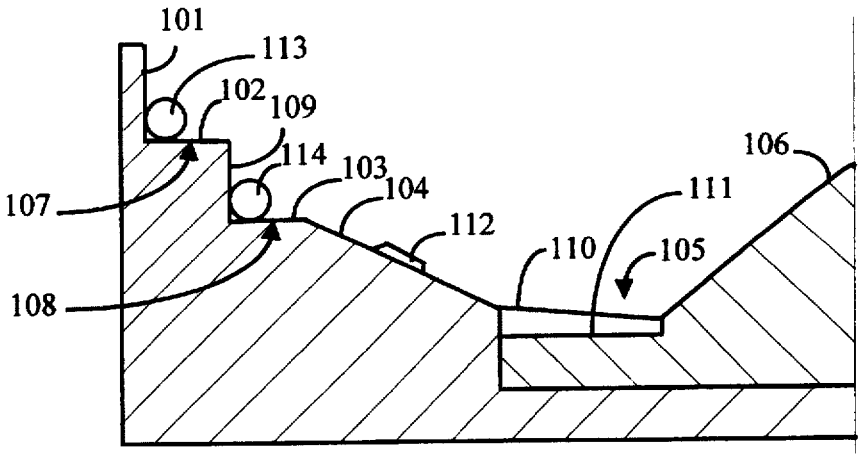
FIG. 1B is a partial elevation section view of the Roulette wheel of FIG. 1A, taken along section line 1B—1B of FIG. 1A.

FIG. 1A is plan view of a Roulette wheel 100 according to an embodiment of the present invention, and FIG. 1B is a partial section view taken along section line 1B—1B of FIG. 1A. In this Roulette wheel there are two outer tracks 107 and 108, each of which comprise a substantially vertical wall and a nearly horizontal land portion. Referring to section view FIG. 1B, track 107 has a substantially vertical wall 101 and a land portion 102, and track 108 has a substantially vertical wall 109 and a land portion 103. An inward tapered portion 104, inclined at about 30 degrees toward the center of the wheel leads from innermost track 108 down to a circular row of numbered cassettes 105, which are the final resting places for Roulette balls propelled into the wheel. Portion 104 has several mounted diamond-shaped projecting structures 112 in this embodiment.

Each cassette 105 is separated from adjacent cassettes by fences on either side. Fence 110 is exemplary of these fences. The fences are all identical in this embodiment, and, although the bottom 111 of each cassette is substantially horizontal, the fence separators are inclined at about 10 degrees toward the center. Finally a center structure rises at about a 45 degree angle from the cassettes to the center of the wheel.

As best seen in FIG. 1B, in this embodiment the two outer tracks and conically-tapered portion 104 are a monolithic structure mounted to a table or other framework to be stationary, while the center section 106 and the cassettes comprise a rotatable portion mounted on bearings to rotate relative to the monolithic outer structure.

In operation in a preferred embodiment, two balls are started in motion at or near the same time, one propelled into outer track 107 and the other into inner track 108. As the balls lose rotary velocity because of physical impediments such as air resistance, friction, and the like, they each move finally and gradually down portion 104 toward the cassettes.

Two balls, 113 and 114, are shown in FIGS. 1A and 1B at an instant in their travel, with ball 113 in track 107 and ball 114 in track 108. In some embodiments, a game operator manually propels each of the balls into their respective tracks, but in preferred embodiments the balls are propelled by devices that are more fully described below. Also, in a preferred embodiment the balls are propelled in the same rotary direction, while center section 106 with cassettes 105 is caused to rotate in a direction opposite that in which the balls are propelled.

It will be especially apparent from section view FIG. 1B that as each ball travels around its respective track against a substantially vertical surface, it also travels on the adjacent substantially horizontal surface of each track, and thus has two points of contact at a different radial distance from the center of curvature of the respective track. Ball 113, for example, contacts vertical wall 101 and land portion 102 of track 107. This dual contact imparts a significant spin to each ball which assures erratic and vigorous action when each ball finally, due to loss of inertia, drops further into the center of the wheel.

It will be apparent from the figures that ball 114 will finally leave track 108 and drop directly into the region of portion 104, while ball 113 will leave track 107 and enter track 108, where it will spin for a while in most instances before also entering the region of portion 104. As each ball spirals down portion 104, each will be deflected by projections 112 adding to the uncertainty of motion for each of the balls.

Projections 112 in this embodiment, as best seen in plan view FIG. 1A, are diamond shaped, with alternating ones presented at different angles to an expected spiral path of a ball in the region of portion 104. In some embodiments balls 113 and 114 are of the same size and weight, but in many embodiments the balls of are of slightly different size and weight.

As each ball reaches cassette 105, traveling spirally in most instances, the ball encounters fence 110 and is further deflected before losing enough energy to finally come to rest in one of the numbered cassettes.

There are a broad range of numbering schemes that may be used for the cassettes, including the well-known schemes currently in use. The system of numbering is not limiting to the invention and may vary in an infinite variety of ways. What is in the embodiment shown is the use of two or more balls integrated in the invention with two or more tracks.

Figure 2:
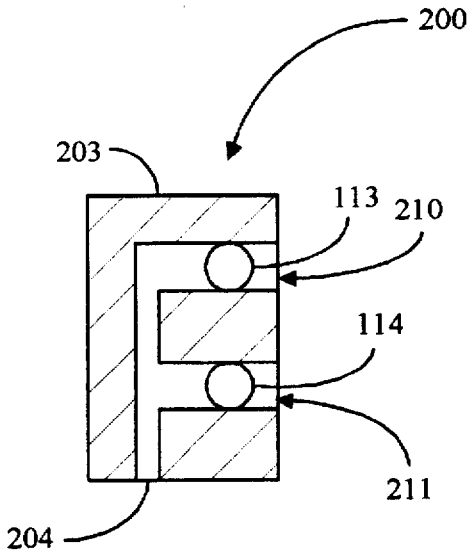
FIG. 2 is a schematic view of a handgun for a roulette game according to an embodiment of the present invention.
Figure 3:
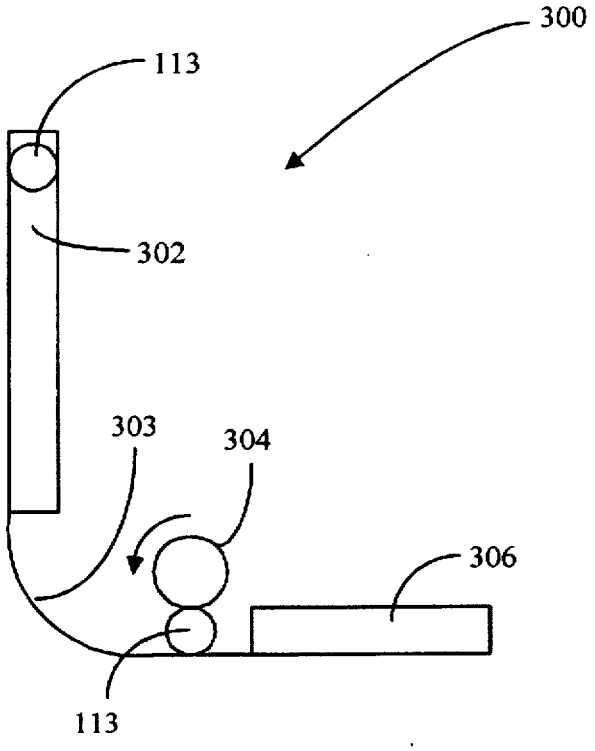
FIG. 3 depicts schematically a mechanical accelerator according to an embodiment of the present invention.

FIG. 2 and FIG. 3 show two different devices adapted for launching two balls. FIG. 2 is a generalized section view of an air-operated apparatus 200 having a frame 203 with internal channels. An input port 204 is connected to a gas conduit (not shown) leading from a source of gas under pressure, which is air in a preferred embodiment. Two exit channels, 210 and 211, are provided for engaging and launching balls 113 and 114. Each of channels 210 and 211 in the embodiment shown has a resilient lining adapted to allow each of balls 113 and 114 to be engaged in a manner that a buildup of air pressure behind the engaged balls will, at some pressure level, overcome the resilience of the lining an d launch the engaged ball in the respective channel at a considerable velocity.

In practice, a sudden and momentary volume of air is injected into port 204 such that both balls are suddenly launched. Otherwise, it is likely that one ball would be launched before the other, dropping the air pressure level behind the unlaunched ball such that the unlaunched ball would never be launched.

It will be apparent to those with skill in the art that the structure shown may vary widely in design within the spirit and scope of the invention, having in various embodiments different restraining and triggering devices and mechanisms. Also, the air launch apparatus may be adapted to the structures of FIGS. 1A and 1B to present the launch channels within tracks 107 and 108 at some dimension above lands 102 and 103 and at a launch angle such that the respective balls will go immediately into the track positions shown in FIG. 1B without the launching apparatus presenting an obstacle to the balls after launch. Such adaptation and positioning is a matter of design choice for those with skill in the art.

In some embodiments, an air lauching device such as depicted generally in FIG. 2 may be a hand-held device wherein an operator may manually load the two balls, position the device (air gun) relative to the two tracks, and then trigger the launch. The device may also be mounted in a manner to be rotated to a neutral position for loading balls, then to a launch position to propel the balls.

FIG. 3 is an elevation view of a mechanical accelerator according to an embodiment of the present invention. In this device a vertical entrance tube 302 provides an entrance channel for ball 113 (or 114). An operator simply drops the ball down the entrance tube. The entrance tube is mounted to bring the ball into the region of one or the other of the two tracks, 107 and 108 of FIGS. 1A and 1B, near the vertical wall of the respective track.

A ball dropped down tube 302 is guided by an internal guide 303 to change the direction of the ball to nearly horizontal. After the direction of the dropped ball is changed, the ball encounters a rapidly spinning wheel 304, having a resilient covering, such as a rubber-like material. Wheel 304 is rotated by an electric motor in this embodiment at a rate that ball 113 is suddenly accelerated into and through a launch tube 306, and hence into a track such as accomplished by the air-operated device described above. Again, this device may be implemented in a wide variety of ways and mounted upon or affixed to the structures previously described in a wide variety of ways without departing from the spirit and scope of the invention.

Figure 4:
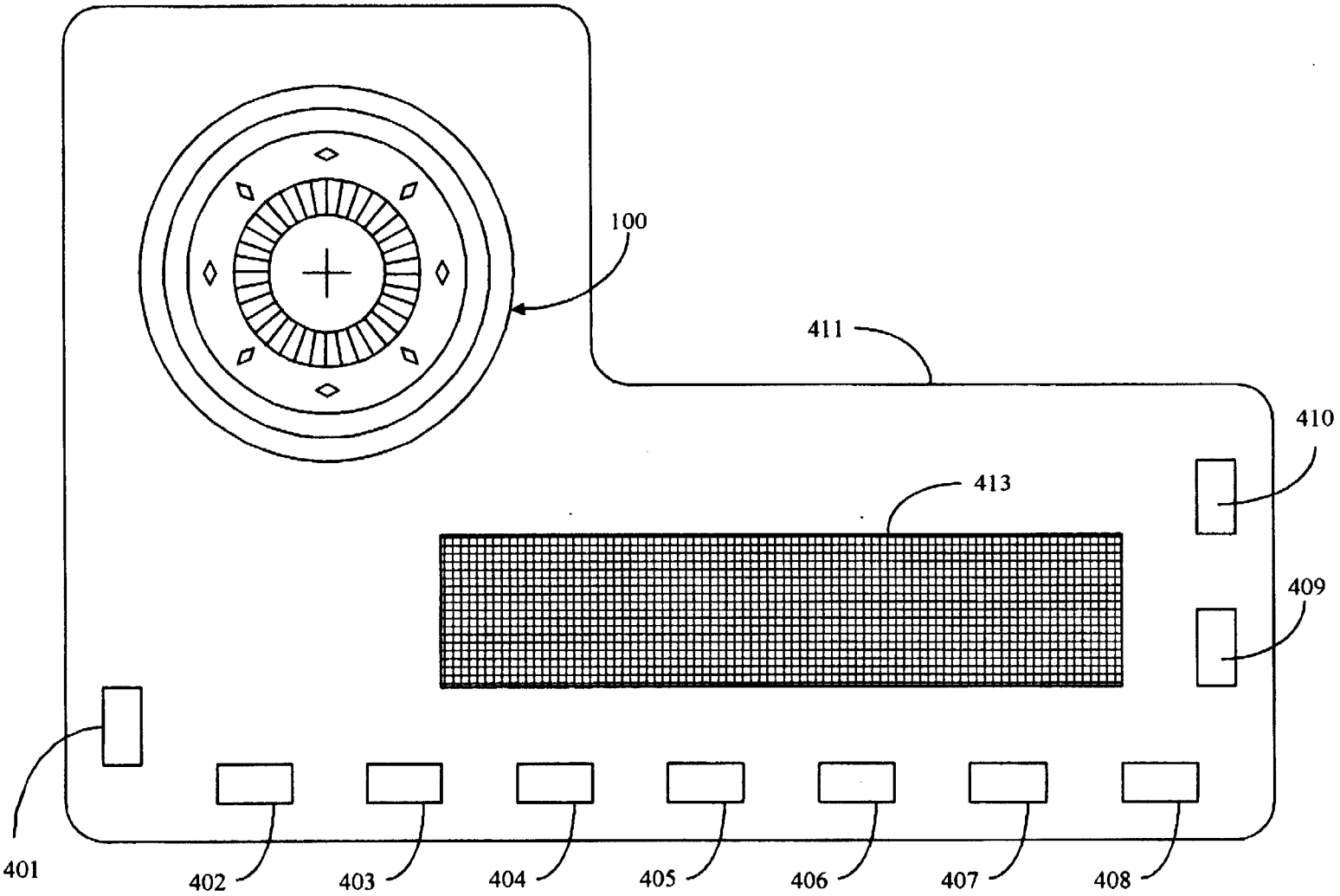
FIG. 4 is a plan view of a Roulette table according to an embodiment of the present invention.

FIG. 4 is a plan view of a Roulette table that has been adapted according to an embodiment of the present invention. Outline 411 is the outer periphery of the table in this embodiment, and has a convenient shape. It will be apparent to those with skill in the art that this particular shape is not limiting to the invention, and many otherr shapes could be employed. Wheel 100 in this embodiment is the Roulette wheel of FIGS. 1A and 1B. Betting field 413 may be of many different forms within the scope of the invention, including those betting fields well-known in the art.

Figure 5:
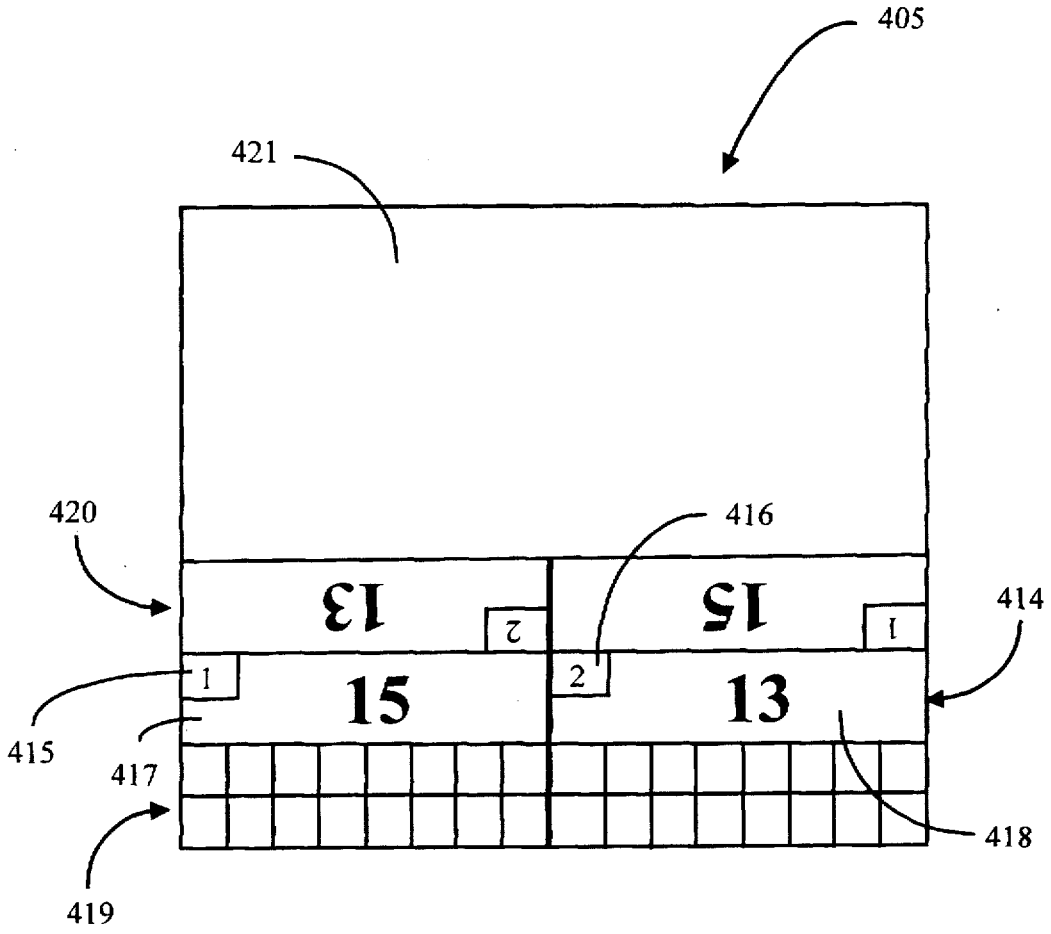
FIG. 5 is a plan view, mostly schematic, of an automated play station according to an embodiment of the present invention.

Positions 401 through 410 in are positions for extra bets. In some embodiments these positions may be permanently marked as to the bet represented by placing money or gambling chips or scrip on one or more of the betting positions. In others there may be input apparatus for players to customize the bets made by using one or another of the slots. FIG. 5 is a generalized plan view representation of such a betting position 405 (for example) having input interfaces for a player.

In FIG. 5, position 405 has a dual-section display (LED, LCD, or the like) with indicators 415 and 416 relating one and the other of the two balls in the game to the associated display sectors 417 and 418 respectively. A dual row 419 of numbered pushbuttons is an input interface for a player to index the digits of the numbers in display sectors 417 and 418.

The numbers that a player enters in the display sectors visible to and readable by the player represent the final positions the player considers likely for each of the balls in the game. Simply entering these numbers, however, does not constitute placing a bet. The player must adjust the numbers in some time window before the balls are launched, or soon after, in most embodiments, and then toggle another input to place the bet, after which a second two-sector display visible to and readable by the operator of the game is illuminated. At the same time, another indicator may be activated indicating the position is activated as carrying a bet. A player must also, of course, place the bet, which is done in the conventional manner by placing money, chips, or scrip in a field 421 for that purpose.

If the player doesn't timely complete placement of a bet within the specified time window, the bet is not accepted. Once the bet is accepted, the player may not withdraw the bet. The payoff for each bet varies, of course, by the likelihood of success (the odds). In some embodiments a bettor is allowed to alter the numbers as the balls progress in the game, with the odds also varying, adding an exciting and fast paced skill level to the game. In a variation of this embodiment, bets are taken only near the end of the spin, allowing a player to alter prediction right down to nearly the time of the balls coming to rest.

It will be apparent to those with skill in the art that the unique enhancements described herein provide for a faster Roulette game with a greater betting turnover and more excitement than generated by conventional Roulette. It will also be apparent to those with such skill that there are many ways the interfaces at a variable betting position as described above may be implemented. Light pens may be used. Levers, knobs and switches of various sorts may also be employed. Bets may be entered in some embodiments as well, without a requirement that the player move chips or scrip onto a betting field.

In preferred embodiments of the present invention sound effects are provided beginning with the launch of the balls and continuing in some embodiments throughout the time the balls are in motion before coming finally to rest in one of the numbered cassettes. In one such embodiment the launch of the balls is accompanied by an enhanced audio version of an air launch (a distinct "whoosh" for example). In another the launch is accompanied by an audio "thunder strike". Combinations of these and other audio enhancements may be used, including enhanced audio of balls rolling in tracks, music, and the like. Such audio enhancements, used with physical wheels, are even more desirable used with versions of the game of the present invention wherein the wheel is a "virtual" wheel, rather than a physical wheel. Games with such virtual wheels are described in more detail below.

In yet another embodiment of the present invention Roulette wheel 100 is not a physical roulette wheel. But a virtual wheel simulated in a display, such as an LCD display. In this embodiment the launchers are typically also virtual, and the audio enhancement described above is a principal feature.

In yet a further embodiment wheel 100 may be a holographic representation of a wheel generated by a computerized apparatus. Such an implementation, together with other simulated wheel implementations, are consistent with a computerized betting input interface for players, and allows play completely without an operator (croupier).

In the case of a holographic wheel the launcher may also be a simulation, or a physical launcher might be used with sensors for providing input to software as input for generating holographic representations of balls in the simulated wheel. Or, the handgun could also be simulated by a holographic representation, which then allows the game to be played without a croupier. Also, by having automated betting positions as described above, such a table could be completely automated, and the speed with which the game can be played could be increased thereby allowing the casinos to accept a smaller share. Using the holographic suspension of the ball would have the advantage that the cycle of the ball running versus the administrative activities on the table could be improved. This would increase the suspension of the game and also increase the pressure on players to place their bets faster.

It will be apparent to those with skill in the art that there are many alterations that may be made in the embodiments described without departing from the spirit and scope of the invention. Many of these variations have already been described. Many others will occur to those with such skill. For example, there are many ways electronics may be implemented to provide automated betting stations. As another example, the structures of the table and the wheel may vary widely. More than two balls may be used and more than two tracks, although two of each is a preferred situation. As another example, there are many different preferences among programmers, and the computerized apparatus described above, including virtual wheels such as LCD displayed wheels and holographic Roulette wheels, might be done in many ways within the scope of the invention. There are many other examples which might be mentioned, so the scope of the invention is limited only by the claims which follow.

What is claimed is:

1. A Roulette wheel comprising:

a first track having a first substantially vertical outer wall in the form of a cylindrical section and a first inwardly inclined land portion extending radially inward from a lower end of the substantially vertical wall;

a second track having a second substantially vertical outer wall in the form of a cylindrical section and a second inwardly inclined land portion extending radially inward from a lower end of the second substantially vertical wall, the vertical outer wall of the second track beginning at the inboard edge of the first track; and a circular region of numbered cassettes below and within the first and second tracks.

2. The Roulette wheel of claim 1 wherein the second track is joined to the circular region of numbered cassettes by an inwardly-inclined conical region, and further comprising an outwardly-inclined conical region within the circular region of numbered cassettes.

3. The Roulette wheel of claim 2 further comprising projections from a surface of the inclined conical region, the projections for interrupting the path of a ball traveling over the surface in the inwardly-inclined conical region.

4. The Roulette wheel of claim 1 further comprising an apparatus adapted for propelling a first ball substantially tangentially into the first track and a second ball substantially tangentially into the second track.

5. The Roulette wheel of claim 4 wherein the apparatus adapted for propelling balls is a hand-held device having separate ejection tubes for the first and second balls, and wherein the balls are propelled by a burst of gas pressure in the ejection tubes.

6. The Roulette wheel of claim 4 wherein the apparatus adapted for propelling balls is a device having a vertically-oriented entrance tube, and a horizontally-inclined ejection tube, and a ball dropped into the entrance tube is propelled from the ejection tube by contact with a driven wheel.

7. A Roulette apparatus comprising:

a first track having a first substantially vertical outer wall in the form of a cylindrical section and a first inwardly inclined land portion extending radially inward from a lower end of the substantially vertical wall;

a second track having a second substantially vertical outer wall in the form of a cylindrical section and a second inwardly inclined land portion extending radially inward from a lower end of the second substantially vertical wall, the vertical outer wall of the second track beginning at the inboard edge of the first track;

a circular region of numbered cassettes below and within the first and second tracks;

a first ball and a second ball; and an apparatus adapted for propelling a first ball substantially tangentially into the first track and a second ball substantially tangentially into the second track.

8. The Roulette apparatus of claim 7 wherein the second track is joined to the circular region of numbered cassettes by an inwardly-inclined conical region, and further comprising an outwardly-inclined conical region within the circular region of numbered cassettes.

9. The Roulette wheel of claim 7 further comprising projections from a surface of the inclined conical region, the projections for interrupting the path of a ball traveling over the surface in the inwardly-inclined conical region.

10. The Roulette wheel of claim 7 wherein the apparatus adapted for propelling balls is a hand-held device having separate ejection tubes for the first and second balls, and wherein the balls are propelled by a burst of gas pressure in the ejection tubes.

11. The Roulette wheel of claim 7 wherein the apparatus adapted for propelling balls is a device having a vertically-oriented entrance tube, and a horizontally-inclined ejection tube, and a ball dropped into the entrance tube is propelled from the ejection tube by contact with a driven wheel.

12. The apparatus of claim 7 further comprising a betting field having numbered areas associated with the numbered cassettes such that players may place bets by placing money, chips or scrip on the numbered areas in the betting field.

13. The apparatus of claim 12 further comprising at least one player station adapted for a player to place additional bets.

14. The apparatus of claim 13 wherein the player station is marked to identify the bet placed.

15. The apparatus of claim 13 wherein the player station comprises an electronic interface including input devices for a player to customize the bet.

* * * * *